US007988331B2

(12) United States Patent
Zheng

(10) Patent No.: US 7,988,331 B2
(45) Date of Patent: Aug. 2, 2011

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 338 days.

(21) Appl. No.: 12/422,213

(22) Filed: Apr. 10, 2009

(65) Prior Publication Data

US 2010/0085752 A1 Apr. 8, 2010

(30) Foreign Application Priority Data

Oct. 8, 2008 (CN) ..... 2008 1 0304773

(51) Int. Cl.
*F21V 21/00* (2006.01)

(52) U.S. Cl. ..... 362/249.02; 362/249.06

(58) Field of Classification Search ..... 362/249.02, 362/241, 247, 294, 235, 238, 362, 370, 432, 362/800, 373, 249.03–249.11
See application file for complete search history.

(56) References Cited

U.S. PATENT DOCUMENTS

| | | | | |
|---|---|---|---|---|
| 6,837,595 | B2 * | 1/2005 | Yoneda | 362/238 |
| 6,874,911 | B2 * | 4/2005 | Yoneda | 362/294 |
| 7,004,603 | B2 * | 2/2006 | Knight | 362/249.03 |
| 7,862,207 | B2 * | 1/2011 | Baldwin et al. | 362/249.07 |
| 2010/0073932 | A1 * | 3/2010 | Zheng | 362/249.06 |
| 2010/0085746 | A1 * | 4/2010 | Zheng | 362/225 |

* cited by examiner

*Primary Examiner* — Anabel Ton
*Assistant Examiner* — Danielle Allen
(74) *Attorney, Agent, or Firm* — Frank R. Niranjan

(57) ABSTRACT

An LED lamp includes a lamp cover, a plurality of brackets received in the lamp cover and interconnecting each other, a plurality of LED modules thermally attached to inner surfaces of the brackets and a plurality of light-guiding covers covering the LED modules, respectively. The brackets have different sizes and are coaxially positioned wherein a larger bracket encloses a smaller bracket. The LED modules are inclined relative to a bottom of the lamp cover and light emitted by the LED modules respectively travels through the light-guiding covers to generate a wide illumination area through the bottom of the brackets.

17 Claims, 7 Drawing Sheets

LED LAMP

BACKGROUND

1. Technical Field

The disclosure relates to an LED (light emitting diode) lamp, and more particularly to an LED lamp having a wide illumination area.

2. Description of Related Art

An LED lamp utilizes light-emitting diodes (LEDs) as a source of illumination. LEDs provide resistance to shock and an almost endless lifetime under specific conditions, making them a cost-effective and high quality replacement for incandescent and fluorescent lamps.

Known implementations of LED modules in an LED lamp make use of a plurality of individual LEDs to generate light. The large number of LEDs, however, increases price and power consumption of the module. Considerable heat is also generated, which, if not adequately addressed at additional expense, impacts LED lamp reliability.

Further, since the LEDs are generally arranged on a printed circuit board having a planar surface, illumination is distributed at a wide variety of spatial angles with marked differences in intensity and brightness, making it unsuitable for environments requiring even and broad illumination.

What is needed, therefore, is an LED lamp which can overcome the limitations described.

BRIEF DESCRIPTION OF THE DRAWINGS

Other advantages and novel features of the disclosure will become more apparent from the following detailed description of an embodiment/embodiments when taken in conjunction with the accompanying drawings.

DETAILED DESCRIPTION

Figure 1:
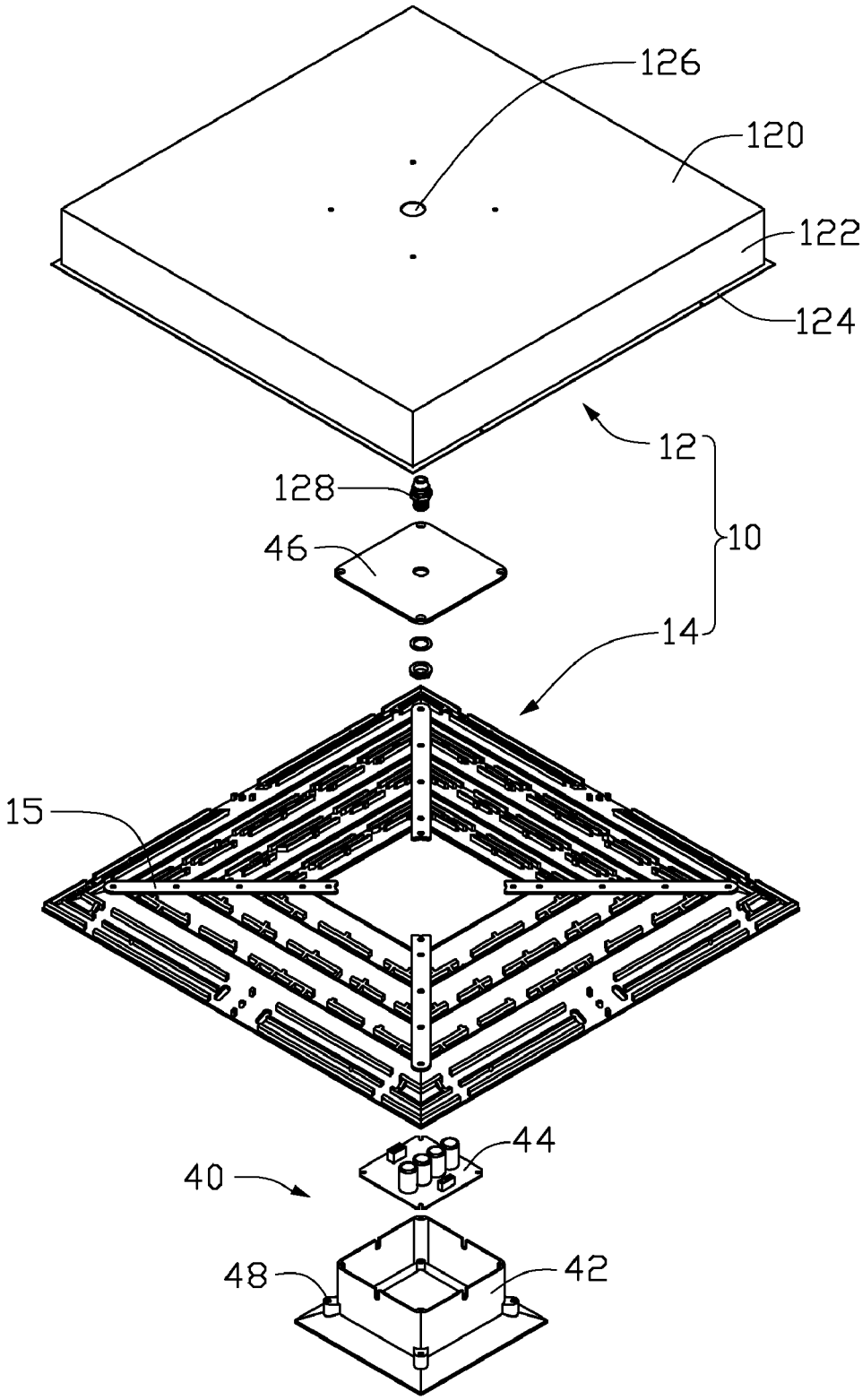
FIG. 1 is an isometric, exploded view of an LED lamp in accordance with an exemplary embodiment of the disclosure.
Figure 2:
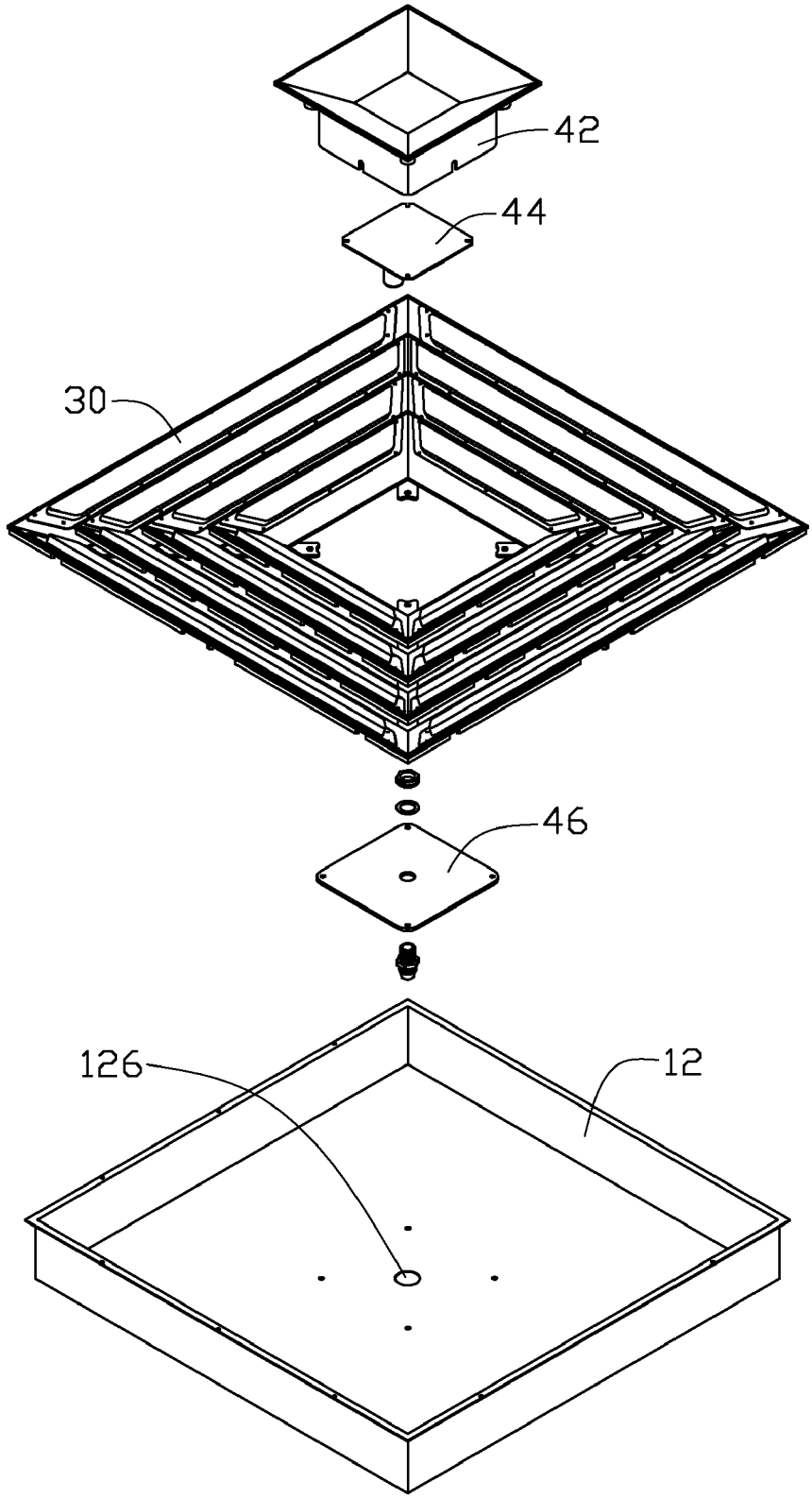
FIG. 2 is an inverted view of FIG. 1.
Figure 3:
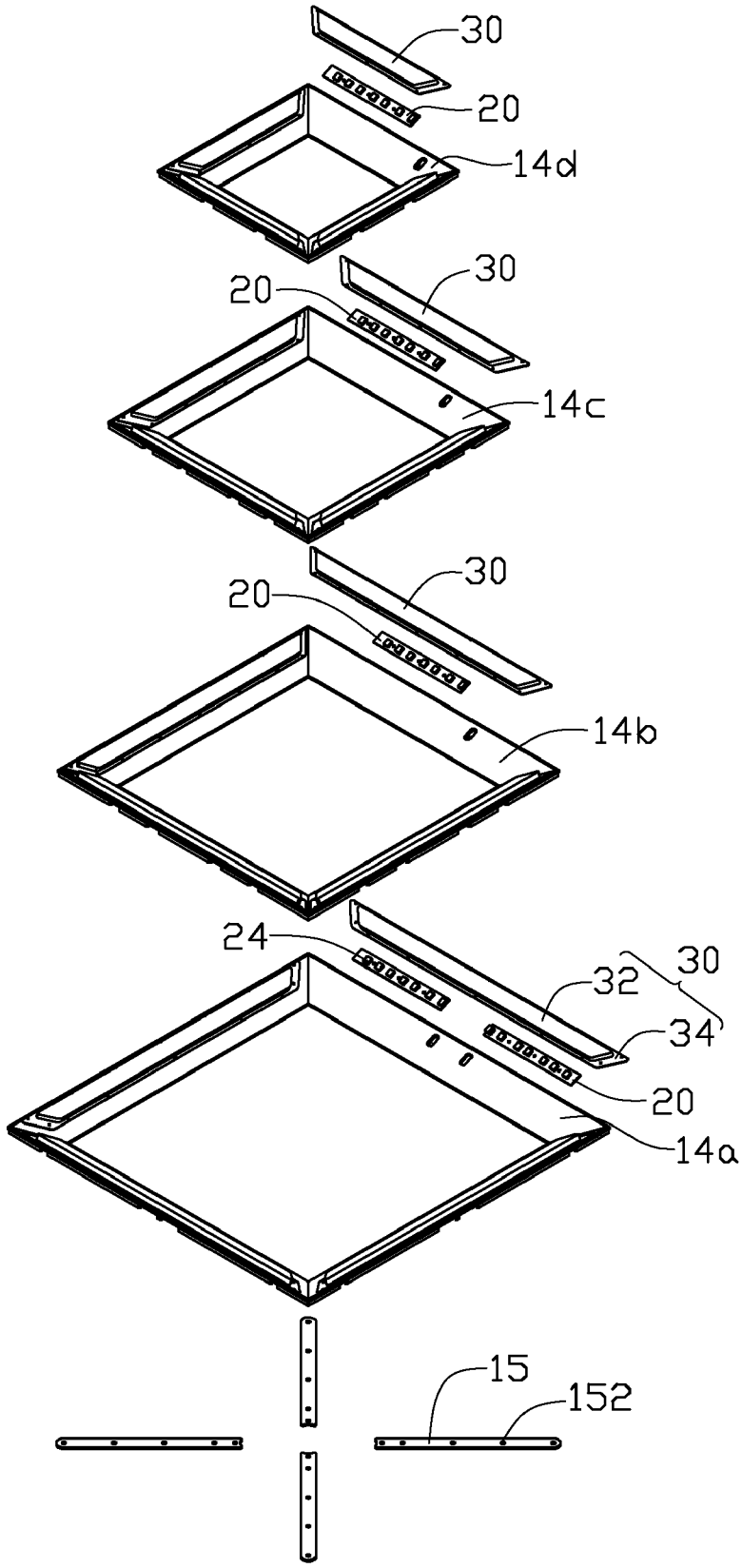
FIG. 3 is an exploded view of a part of the LED lamp of FIG. 2.
Figure 4:
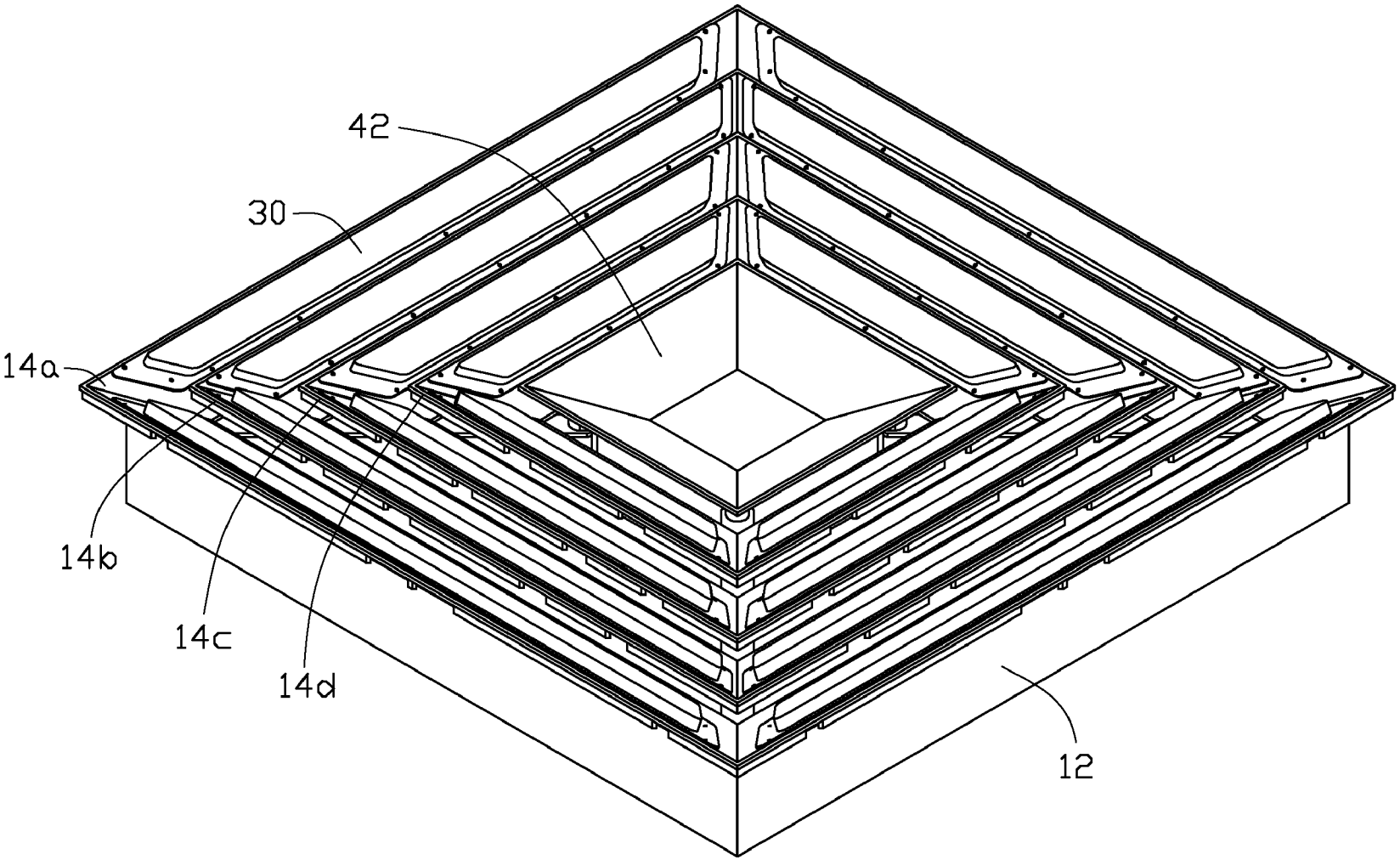
FIG. 4 is an assembled view of FIG. 2.
Figure 5:
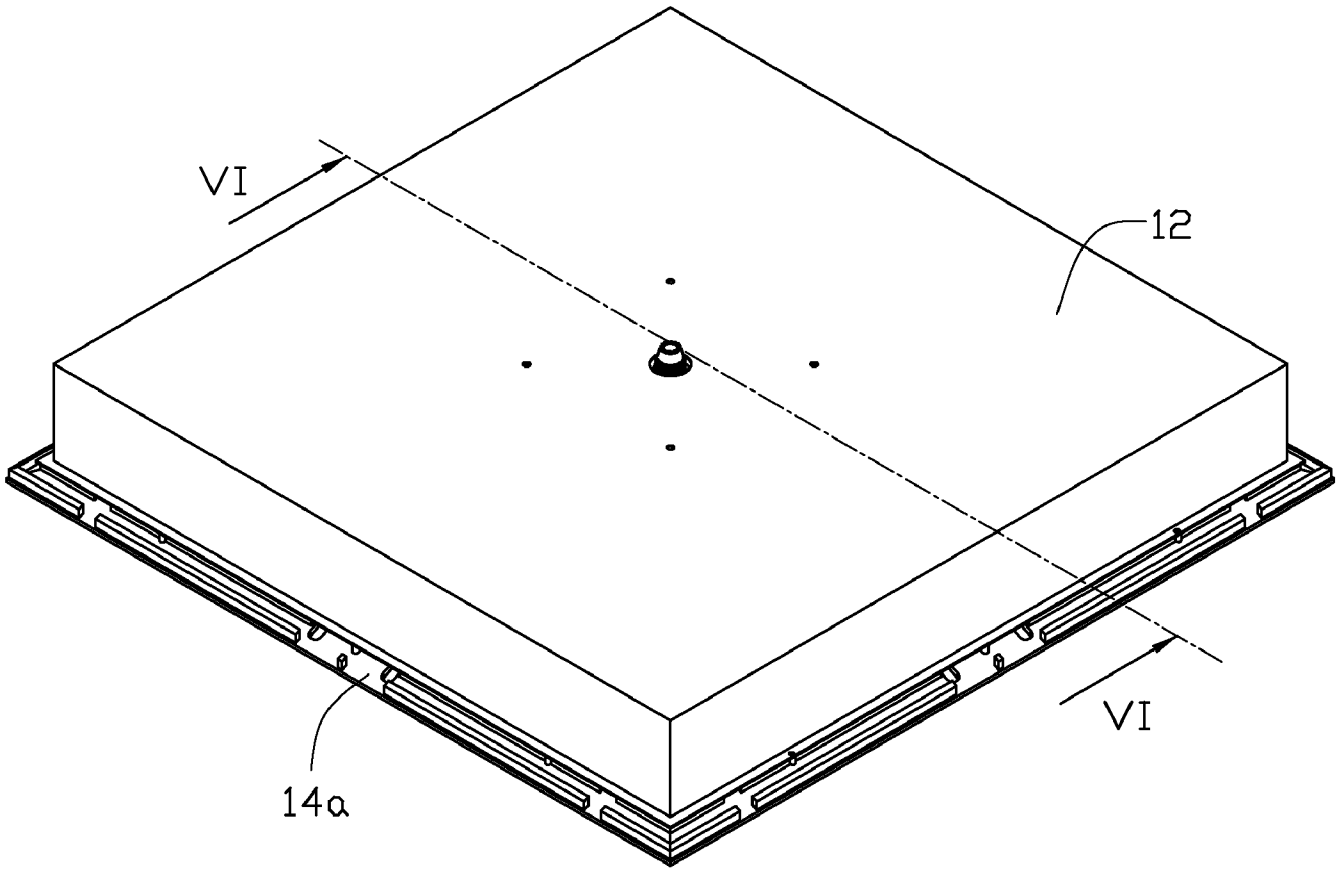
FIG. 5 is an assembled view of FIG. 1.
Figure 6:
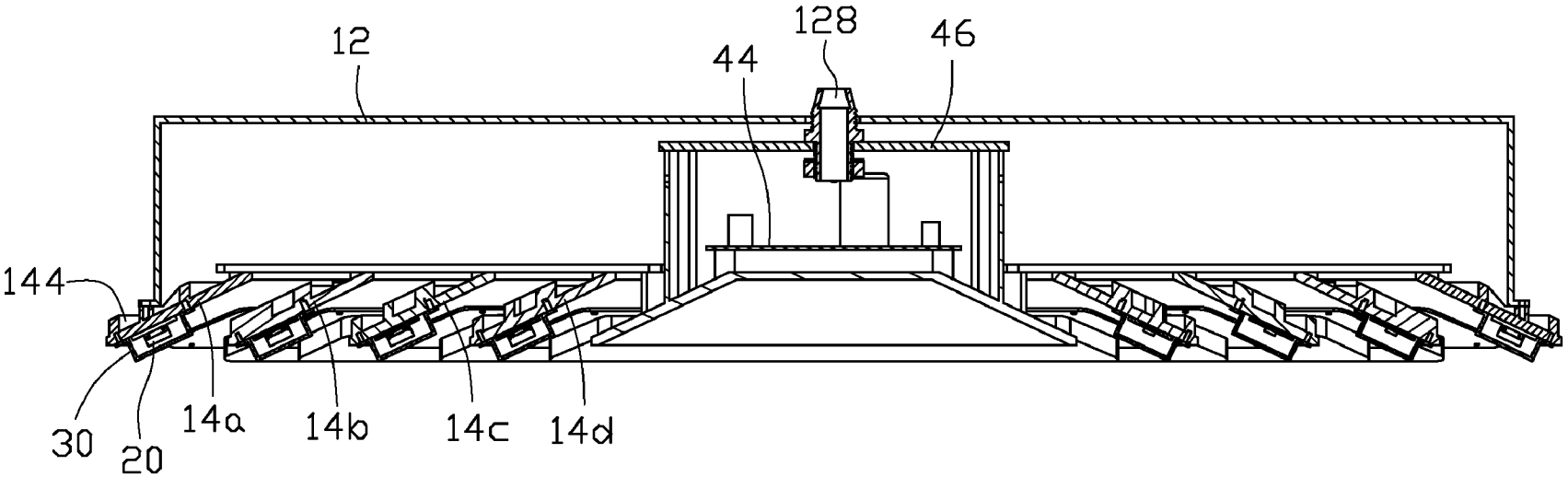
FIG. 6 is a cross-section of the LED lamp of FIG. 5, taken along line VI-VI thereof.

Referring to FIGS. 1-6, an LED lamp (not labeled) in accordance with an exemplary embodiment is illustrated. The LED lamp is configured for providing illumination indoors. The LED lamp includes a retaining assembly 10, a plurality of LED modules 20 fixed to an underside surface of the retaining assembly 10, a plurality of light-guiding covers 30 respectively covering the LED modules 20 and a driving circuit module 40 mounted to the retaining assembly 10.

The retaining assembly 10 comprises a lamp cover 12, a plurality of brackets 14 covered by the lamp cover 12 and a plurality of mounting plates 15 fastening the brackets 14 together. The lamp cover 12 has a rectangular configuration. The lamp cover 12 comprises a rectangular top panel 120 and four connecting plates 122 extending perpendicularly and downwardly from four side edges of the top panel 120. The top panel 120 and the four connecting plates 122 cooperatively define a space receiving the brackets 14 therein. A flange 124 extends horizontally and outwardly from a bottom edge of each connecting plate 122, for facilitating engaging one corresponding bracket 14. The top panel 120 defines a through hole 126 in a center thereof. A mounting member 128 is received in the through hole 126 and mounted to the centre of the top panel 120 of the lamp cover 12 for positioning the LED lamp at a desired position.

The brackets 14 each are integrally formed of a material with good heat conductivity such as aluminum or copper. In this embodiment, the number of the brackets 14 is four. The four brackets 14*a*~14*d* are coaxially positioned and have different sizes, with a larger one enclosing a smaller one, wherein the bracket 14*a* has the largest size and the bracket 14*d* has the smallest size. The four brackets 14*a*~14*d* each have a square, ring-shaped configuration. The largest bracket 14*a* is located at the outermost position, while the smallest bracket 14*d* is located at the innermost position. The outermost bracket 14*a* engages with the flanges 124 of the connecting plates 122 of the lamp cover 12. The brackets 14*a*~14*d* each define a first opening (not labeled) at a top thereof and a second opening (not labeled) at a bottom thereof opposite to the first opening. The second opening is larger than the first opening. The brackets 14*a*~14*d* each form a plurality of ribs 144 on an outer surface thereof, for increasing heat-dissipating area and enhancing strength of the brackets 14*a*~14*d*. Every two adjacent ones of the brackets 14*a*~14*d* cooperatively define a passage (not labeled) for cooling air passing through. Each of the brackets 14*a*~14*d* comprises four lateral plates (not labeled) interconnecting each other to enclose a space. Each lateral plate has an isosceles trapezoid shape. The lateral plates of each of the brackets 14*a*~14*d* are inclined relative to a bottom of the lamp cover 12. Inclined angles of the lateral plates of the brackets 14*a*~14*d* ranges from 30 degrees to 60 degrees, whereby the LED modules 20 attached to the inner sidewalls of the lateral plates of the brackets 14*a*~14*d* can generate a wider illumination area and a desired illumination intensity through a bottom of the LED lamp. The brackets 14*a*~14*d* each define a holes (not labeled) therein, adjacent to an end of one corresponding LED module 20, for extension of electrical wires of the corresponding LED module 20 therethrough. The mounting plates 15 each define five spaced screwing holes 152 therein. Fasteners (not labeled) extend through the screwing holes 152 of the mounting plates 15 and screw in the brackets 14*a*~14*d* to mount the four brackets 14*a*~14*d* together.

Additionally, the number of the brackets 14 may be increased or decreased to meet the increase or decrease of the number of the LED modules 20, which is determined according to the required illumination of the LED lamp.

The LED modules 20 are thermally attached to the inner sidewalls of the lateral plates of the brackets 14*a*~14*d*, respectively. Heat generated by the LED modules 20 is dissipated by the brackets 14*a*~14*d*, more particularly by the ribs 144 of the brackets 14*a*~14*d*. Due to the biggest size of the outermost bracket 14*a*, two LED modules 20 are attached to the inner sidewall of each lateral plate of the outermost bracket 14*a*, for sufficiently utilizing the outermost bracket 14*a* to generate a wider illumination area. The lateral plates of the outermost bracket 14*a* each define two holes (not labeled) in a middle portion thereof, for extension of electrical wires of the corresponding LED module 20 therethrough. However, only one LED module 20 is attached to the inner sidewall of every lateral plate of the brackets 14*b*~14*d*, according to sizes of the brackets 14*b*~14*d*. Each LED module 20 comprises a rectangular printed circuit board 22 and a plurality of LED components 24 arranged thereon.

The light-guiding covers 30 are transparent/translucent plastic or glass, for guiding light emitted by the LED modules 20 in this embodiment. The light-guiding covers 30 each have a trapeziform-shaped section corresponding to the shape of each of the LED modules 20. Each light-guiding cover 30 comprises a coping 32 enclosing the corresponding LED module 20 and an annular flange 34 extending outwardly from a rim of the coping 32. The annular flanges 34 are attached to and securely engage the inner surfaces of the lateral plates of the brackets 14*a*~14*d*, respectively.

The driving circuit module 40 is received in and secured to a center of the retaining assembly 10. The driving circuit module 40 comprises a rectangular box 42 receiving a required electrical circuit 44 therein and a lid 46 covering and coupled to the box 42. The box 42 defines four mounting holes 48 in four corners along a periphery thereof. Fasteners extend through top ends of the mounting plates 15 and screw in the mounting holes 48 of the driving circuit module 40 to mount the driving circuit module 40 to the mounting plates 15. The lid 46 defines a through hole (not labeled) in a center thereof to securely receive the mounting member 128 therein. The mounting member 128 has an upper end secured in the through hole 126 of the top panel 120 of the lamp cover 12 to complete the assembly of the LED lamp.

In use, light emitted by the LED modules 20 located on different brackets 14*a*~14*d* passes the corresponding light-guiding covers 30 and emits outwardly to generate a wide illumination area through the bottom of the LED lamp.

Figure 7:
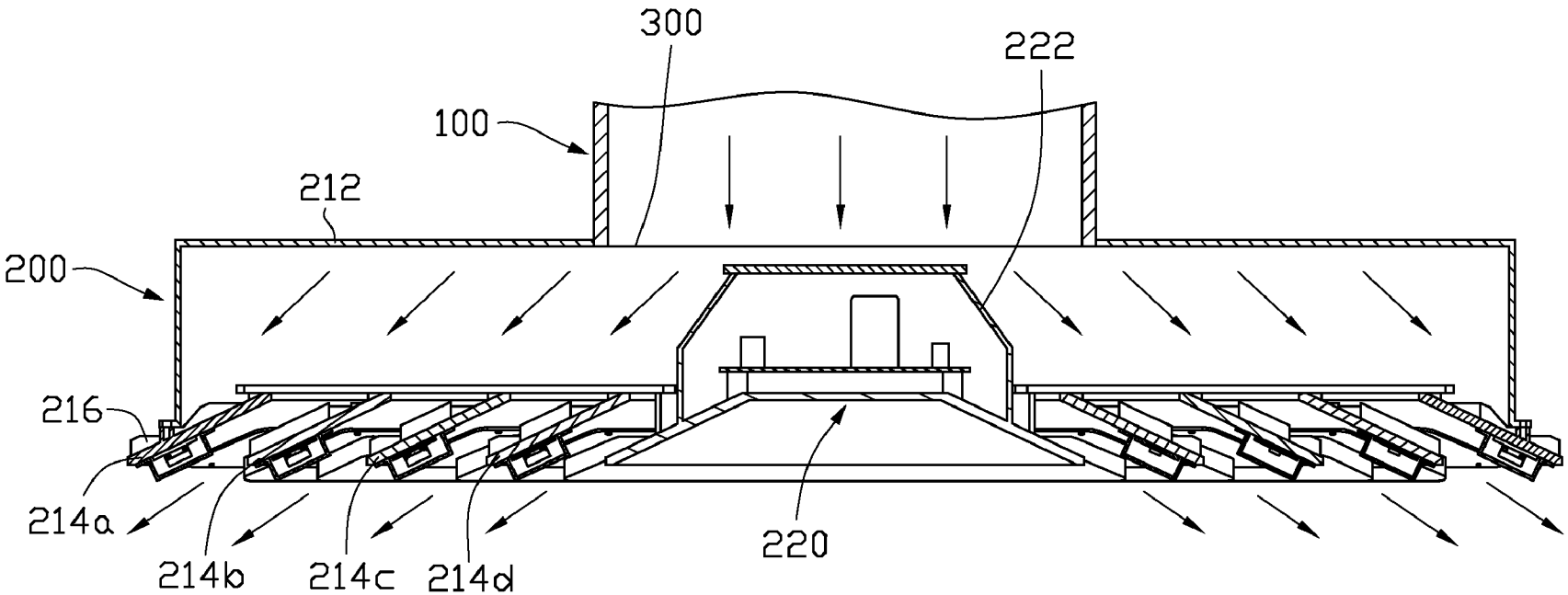
FIG. 7 is a cross-section of an LED lamp in accordance with another exemplary embodiment of the disclosure, with arrows showing paths of airflow passing through the LED lamp.

Referring to FIG. 7, an LED lamp in accordance with another exemplary embodiment is illustrated. The difference between this embodiment and the previous embodiment rests in that an air-producing device 100 is mounted on an LED lamp 200. The difference between the LED lamp 200 and the LED lamp of FIGS. 1-6 is that the LED lamp 200 comprises a lamp cover 212 functioning as an air duct. The lamp cover 212 defines an air-inlet 300 in a center thereof, allowing airflow from the air-producing device 100 to pass therethrough. The LED lamp 200 further comprises a driving circuit module 220 having a box 222. The box 222 comprises a face (not labeled) slantwise to a bottom of the lamp cover 212, thereby facilitating guiding the airflow to pass through the LED lamp 200. Accordingly, the ribs 216 of the brackets 214*a*~214*d* of the LED lamp 200 are strip-shaped, for facilitate guiding the airflow to flow an outside. An air channel (not labeled) is defined in every two adjacent ones of the brackets 214*a*~214*d* of the LED lamp 200. An air outlet (not labeled) is defined in a bottom of the LED lamp 200. The airflow from the air-inlet 300 passes through the air channels and then away from the LED lamp 200 via the air outlet. In operation, the airflow flows into the inside of the LED lamp 200 via the air-inlet 300, passes through the air channels and then away from the LED lamp 200 via the air outlet.

Since the air-producing device 100 and the LED lamp 200 are assembled together, heat generated by the LED lamp 200 is dissipated by the air-producing device 100 and any additional heat-dissipation device is not needed. In addition, the LED lamp 200 is connected to the air-producing device 100, any additional fixing fixture is not needed.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED (light emitting diode) lamp comprising:

a plurality of barrel-shaped brackets of different sizes, wherein a larger bracket enclosing a smaller bracket, the brackets defining a first open end and a second open end opposite to the first open end, the brackets gradually decreasing in diameter from the first open end to the second open end;

a plurality of mounting plates fastening the brackets together;

a plurality of LED modules thermally attached to inner surfaces of each of the brackets; and a plurality of light-guiding covers covering the LED modules, respectively;

wherein the LED modules are arranged inclined relative to a bottom of the brackets to generate a wide illumination through the bottom of the brackets.

2. The LED lamp as claimed in claim 1, wherein the brackets each comprise a plurality of lateral plates interconnecting each other and the LED modules are attached on inner surfaces of the lateral plates, respectively.

3. The LED lamp as claimed in claim 2, wherein the lateral plates of the brackets are inclined to the bottom of the LED lamp.

4. The LED lamp as claimed in claim 1, wherein the brackets each comprises a plurality of ribs on an outer surface thereof.

5. The LED lamp as claimed in claim 1, further comprising a driving circuit module received in the brackets and mounted to ends of the mounting plates.

6. The LED lamp as claimed in claim 1, further comprising a lamp cover enclosing the brackets therein, the lamp cover comprising a top panel and a plurality of connecting plates extending from side edges of the top panel.

7. The LED lamp as claimed in claim 6, wherein the lamp cover further comprises a mounting member mounted to the top panel of the lamp cover, for positioning the LED lamp at a desired position.

8. The LED lamp as claimed in claim 1, wherein the brackets each have a square, ring-shaped configuration.

9. The LED lamp as claimed in claim 8, wherein an angle of an inner sidewall of each of the brackets relative to a bottom of a corresponding one of the brackets ranges from 30 degrees to 60 degrees.

10. The LED lamp as claimed in claim 1, wherein brackets each define a holes therein, adjacent to an end of one corresponding LED module, for extension of electrical wires of the corresponding LED module therethrough.

11. An LED (light emitting diode) lamp assembly comprising:

an air-producing device;

an LED lamp connected to the air-producing device and defining an air-inlet facing the air-producing device, the LED lamp comprising:

a plurality of ring-shaped brackets interconnecting each other and, the brackets gradually decreasing in size from an outside to an inside of the brackets, a larger bracket enclosing a smaller bracket;

a plurality of LED modules thermally attached to inner surfaces of the brackets to generate an illumination through a bottom of the brackets, orientations of the LED modules being slantwise to the bottom of the brackets; and a plurality of light-guiding covers covering the LED modules, respectively.

12. The LED lamp assembly as claimed in claim 11, wherein the LED lamp further comprises a lamp cover receiving the brackets therein and the air-inlet is defined through the lamp cover.

13. The LED lamp assembly as claimed in claim 12, wherein the lamp cover comprises a top panel and a plurality of connecting plates extending downwardly from side edges of the top panel.

14. The LED lamp assembly as claimed in claim 11, wherein the LED lamp further comprises a plurality of mounting plates fastening the brackets together.

15. The LED lamp assembly as claimed in claim 14, wherein the brackets each comprise a plurality of lateral plates interconnecting each other to define a space and the LED modules are attached on inner surfaces of the lateral plates, respectively.

16. The LED lamp assembly as claimed in claim 15, wherein the brackets each comprise a plurality of ribs on outer surfaces thereof.

17. The LED lamp assembly as claimed in claim 11, wherein the LED lamp further comprises a driving circuit module received in the brackets and mounted to a top of the LED lamp, and wherein the driving circuit module comprises an inclined face slantwise to the bottom of the LED lamp to facilitate guiding airflow produced by the air-producing device to pass through the LED lamp.

* * * * *